US008636623B2

(12) United States Patent
Ross et al.

(10) Patent No.: US 8,636,623 B2
(45) Date of Patent: Jan. 28, 2014

(54) FOLDING HURDLE

(75) Inventors: Adam L. Ross, West Chester, OH (US); Benjamin P. Boyer, Ridgeley, WV (US)

(73) Assignee: Exemplar Design, LLC, Mason, OH (US)

( * ) Notice: Subject to any disclaimer, the term of this patent is extended or adjusted under 35 U.S.C. 154(b) by 286 days.

(21) Appl. No.: 13/089,713

(22) Filed: Apr. 19, 2011

(65) Prior Publication Data

US 2011/0263386 A1 Oct. 27, 2011

Related U.S. Application Data

(60) Provisional application No. 61/326,810, filed on Apr. 22, 2010.

(51) Int. Cl.
*A63B 21/00* (2006.01)

(52) U.S. Cl.
USPC ..... 482/15; 482/14; 482/38; 482/41

(58) Field of Classification Search
USPC ..... 482/71, 66, 68, 74, 75, 15, 14
See application file for complete search history.

(56) References Cited

U.S. PATENT DOCUMENTS 1,044,128 A 9/1911 Brook
2,805,062 A 9/1957 Holmes
3,366,381 A 1/1968 Ross
5,033,737 A 7/1991 Moye
5,520,597 A * 5/1996 Tobin ..... 482/66
7,785,233 B1 * 8/2010 Moore ..... 482/15

OTHER PUBLICATIONS

Amazon.com: Smart Hurdles: Sports & Outdoors, Smart Hurdles, Amazon.com, 2012, http://www.amazon.com/Everything-Track-and-Field-Hurdles/dp/B000670KGQ—date retrieved May 15, 2012.
Amazon.com: Champion Sports Adjustable Hurdle Kit: Sports & Outdoors, Champion Sports Adjustable Hurdle Kit, Amazon.com, 2012,—http://www.amazon.com/Champion-Sports-Adjustable-Hurdle-Kit/dp/B002YQDDGG/ref=sr_1_1? s=sporting-goods &ie=UTF8&qid=1335187331&sr=1_1—date retrieved May 15, 2012.

* cited by examiner

*Primary Examiner* — Jerome w Donnelly
(74) *Attorney, Agent, or Firm* — Baker & Hostetler LLP

(57) ABSTRACT

Folding hurdles are disclosed. Some example folding hurdles may include a generally horizontal bar. A first leg may be pivotably coupled to a first end of the generally horizontal bar. The first leg may include a generally horizontally extending first foot and/or may be pivotable between an erected position in which the first foot is oriented generally perpendicular to the generally horizontal bar and a folded position in which the first foot is substantially coplanar with the generally horizontal bar. A second leg may be pivotably coupled to a second end of the generally horizontal bar. The second leg may include a generally horizontally extending second foot and/or the second leg may be pivotable between an erected position in which the second foot is oriented generally perpendicular to the generally horizontal bar and a folded position in which the second foot is substantially coplanar with the generally horizontal bar.

9 Claims, 8 Drawing Sheets

FOLDING HURDLE

CROSS REFERENCE TO RELATED APPLICATION

This application claims the benefit of U.S. Provisional Application No. 61/326,810, filed Apr. 22, 2010, which is hereby incorporated by reference.

BACKGROUND

The present disclosure generally pertains to athletic training equipment and, more particularly, to hurdles.

SUMMARY

Athletic training equipment is generally disclosed. Some example embodiments may include methods, apparatus, and/or systems pertaining to folding hurdles.

Some example folding hurdles according to the present disclosure may include a generally horizontal bar including a first end and a second end. A first leg may be pivotably coupled to the first end of the generally horizontal bar. The first leg may include a generally horizontally extending first foot and/or may be pivotable between an erected position in which the first foot is oriented generally perpendicular to the generally horizontal bar and a folded position in which the first foot is substantially coplanar with the generally horizontal bar. A second leg may be pivotably coupled to the second end of the generally horizontal bar. The second leg may include a generally horizontally extending second foot and/or the second leg may be pivotable between an erected position in which the second foot is oriented generally perpendicular to the generally horizontal bar and a folded position in which the second foot is substantially coplanar with the generally horizontal bar.

Some example folding hurdles according to the present disclosure may include a first leg and a second leg. The first leg may include a first generally horizontal foot, a first generally upwardly facing opening, and a bent knee portion interposing the first generally horizontal foot and the first generally upwardly facing opening. The second leg may include a second generally horizontal foot, a second generally upwardly facing opening, and a bent knee portion interposing the second generally horizontal foot and the second generally upwardly facing opening. A generally horizontal bar may extend between the first leg and the second leg. The generally horizontal bar may include a first end and a second end. The first end may include a first generally downwardly extending tube insert configured to be pivotably received within the first generally upwardly facing opening of the first leg. The second end may include a second generally downwardly extending tube insert configured to be pivotably received within the second generally upwardly facing opening of the second leg. The first generally downwardly extending tube insert may include a laterally extending first spring-biased button. The first leg may include a first erected position lock hole configured to engage the first spring-biased button when the first leg is in an erected position and/or a first folded position lock hole configured to engage the first spring-biased button when the first leg is in a folded position. The second generally downwardly extending tube insert may include a laterally extending second spring-biased button. The second leg may include a second erected position lock hole configured to engage the second spring-biased button when the second leg is in an erected position and/or a second folded position lock hole configured to engage the second spring-biased button when the second leg is in a folded position.

Some example methods of operating folding hurdles according to the present disclosure may include providing a folding hurdle including a generally horizontal bar, a first leg pivotably coupled to a first end of the generally horizontal bar, and a second leg pivotably coupled to a second end of the substantially horizontal bar; disengaging a first lock preventing rotation of the first leg relative to the generally horizontal bar; rotating the first leg from a folded position in which a first foot associated with the first leg is substantially coplanar with the generally horizontal bar to an erected position in which the first foot is generally perpendicular to the generally horizontal bar; engaging the first lock; disengaging a second lock preventing rotation of the second leg relative to the generally horizontal bar; rotating the second leg from a folded position in which a second foot associated with the second leg is substantially coplanar with the generally horizontal bar to an erected position in which the second foot is generally perpendicular to the generally horizontal bar; and engaging the second lock.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

In the drawings.

DETAILED DESCRIPTION

Figure 1:
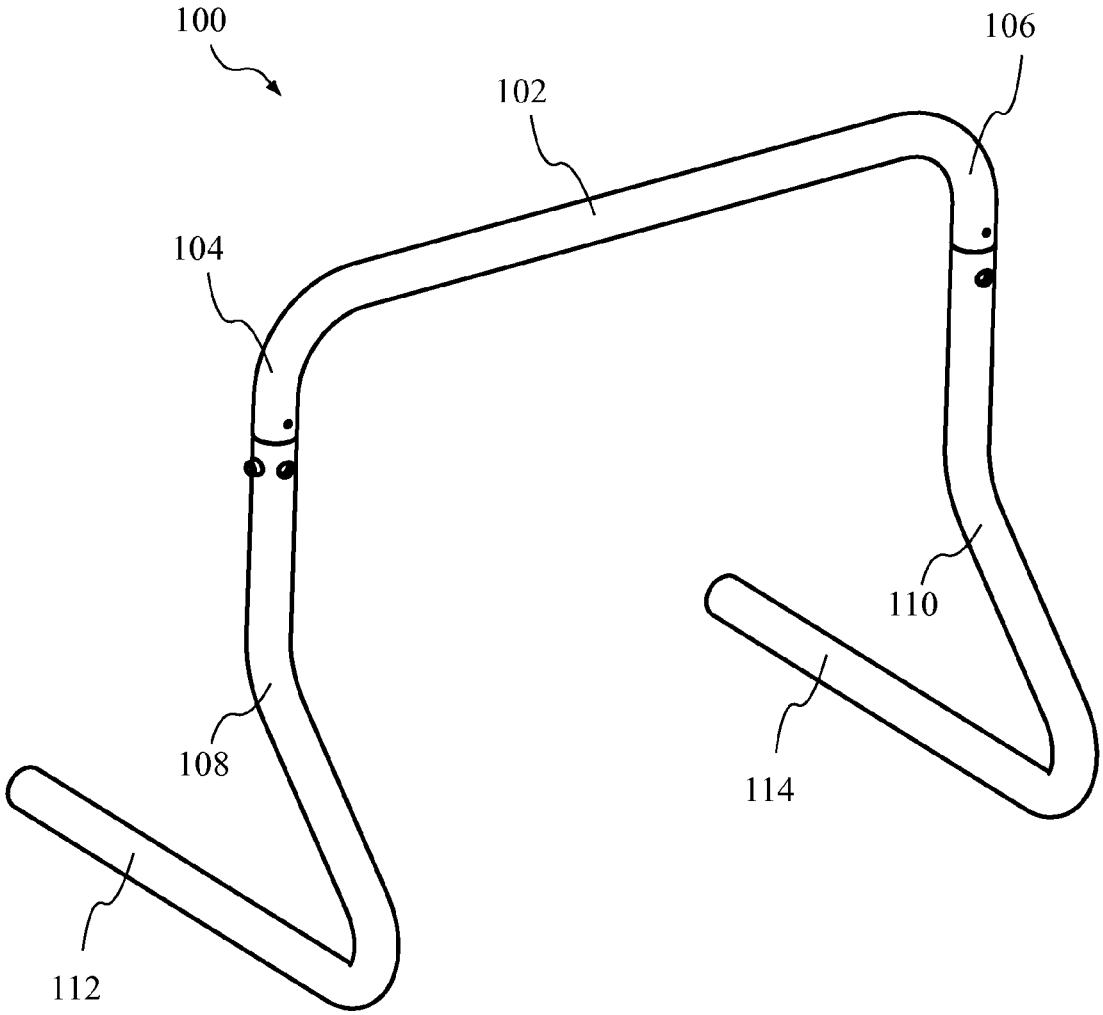
FIG. 1 is a perspective view of an example folding hurdle in an erected configuration.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Methods, systems, devices, and/or apparatus related to athletic training equipment are described. Some example embodiments according to the present disclosure may pertain to folding hurdles.

FIG. 1 is a perspective view of an example folding hurdle 100 in an erected configuration, in accordance with at least some embodiments of the present disclosure. Hurdle 100 may include a generally horizontal bar 102, which may include a first end 104 and a second end 106. Hurdle 100 may include a first leg 108 coupled to first end 104 of bar 102 and/or a second leg 110 coupled to second end 106 of bar 102. First leg 108 and/or second leg 110 may extend generally downwardly from bar 102 and/or may support bar 102 above a support surface. First leg 108 may include a generally horizontally extending first foot 112 and/or second leg 110 may include a generally horizontally extending second foot 114.

In some example embodiments, bar 102, first leg 108, and/or second leg 110 may be generally tubular (e.g., comprising an outer wall and a substantially hollow center). For example, bar 102, first leg 108, and/or second leg 110 may have generally circular cross sections with substantially hollow centers. In some alternative example embodiments, bar 102, first leg 108, and/or second leg 110 may comprise tubular components with non-circular cross sections (e.g., generally square, generally rectangular, generally oval, etc.) and/or bar 102, first leg 108, and/or second leg 110 may be at least partially substantially solid. Bar 102, first leg 108, and/or second leg 110 may be constructed from any suitable material known in the art, such as plastics, metals, composites, and the like.

In an erected configuration as illustrated in FIG. 1, first leg 108 and/or second leg 110 may be arranged in respective erected positions such that first foot 112 and/or second 114 are oriented generally perpendicular to bar 102. In an erected configuration, first foot 112 and/or second 114 may be placed on a support surface. Bar 102 may be supported above and generally parallel to the support surface.

Figure 2:
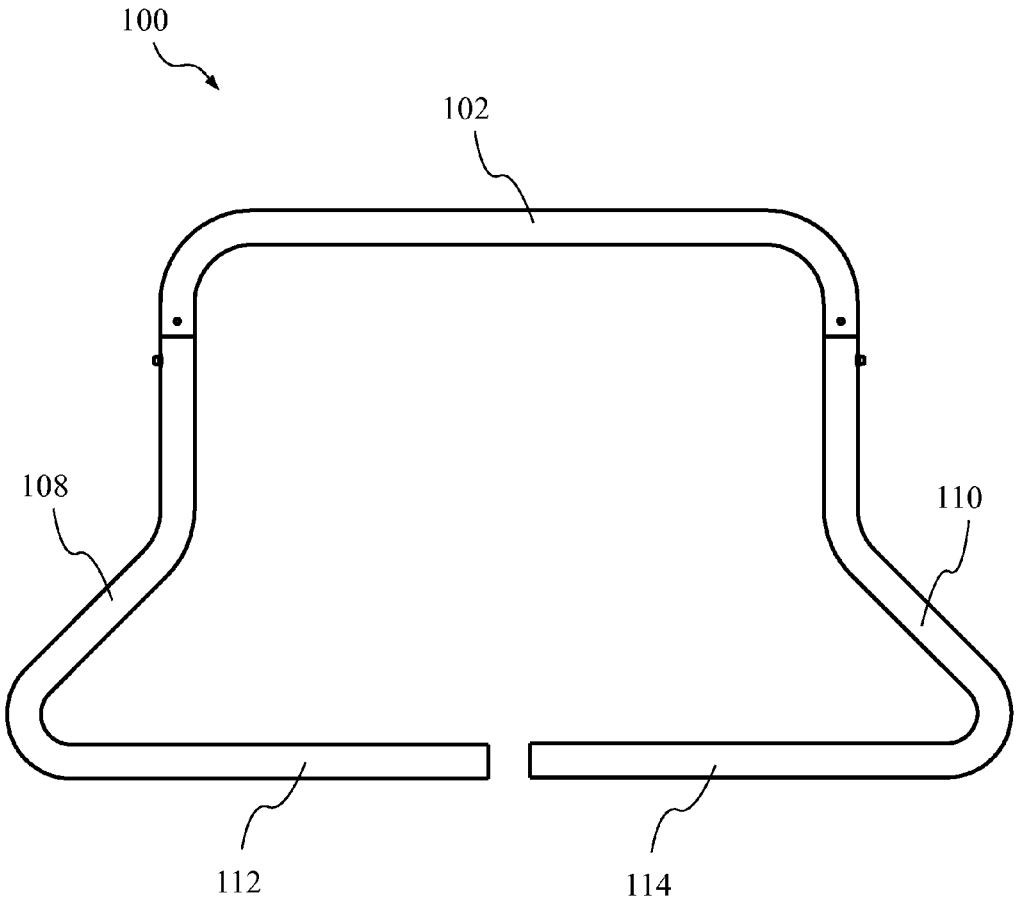
FIG. 2 is a plan view of example folding hurdle in a folded configuration.

FIG. 2 is a plan view of folding hurdle 100 in a folded configuration, in accordance with at least some embodiments of the present disclosure. In a folded configuration as illustrated in FIG. 2, hurdle 100 may be substantially flat, which may be useful, for example, for storage and/or transportation of hurdle 100. In other words, in the folded configuration, bar 102, first leg 108, and/or second leg 110 may be substantially coplanar with each other. In some example embodiments, first leg 108 and/or second leg 110 may be arranged in respective folded positions such that first foot 112 and/or second foot 114 are substantially parallel with bar 102.

Figure 3:
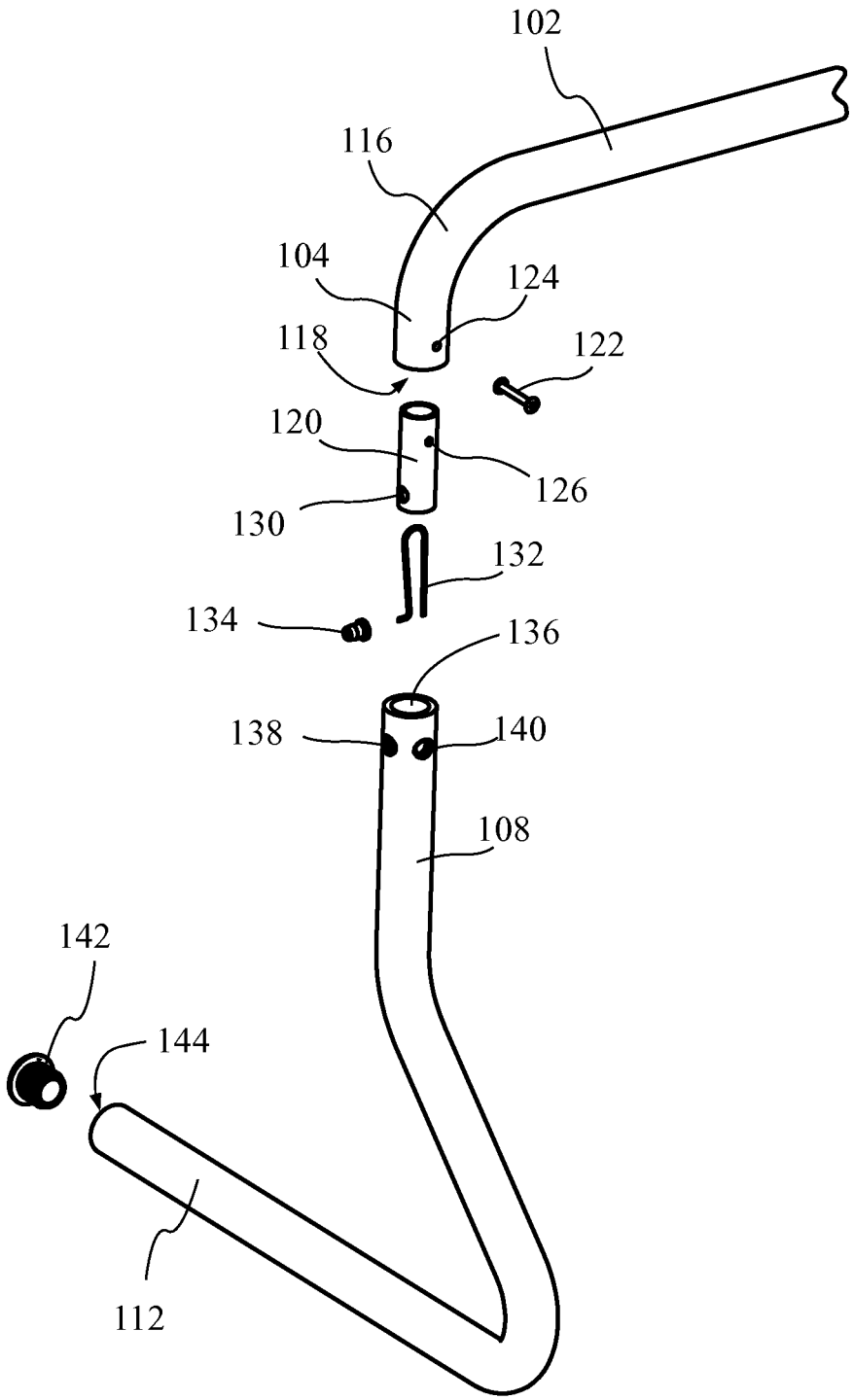
FIG. 3 is an exploded perspective view of one side of an example folding hurdle.

FIG. 3 is an exploded perspective view of one side of folding hurdle 100, in accordance with at least some embodiments of the present disclosure. First leg 108 may be pivotably coupled to bar 102 to allow articulation between the erected position (FIG. 1) and the folded position (FIG. 2). First end 104 of bar 102 may include an elbow portion 116, which may bend generally downwardly about 90 degrees from horizontal and/or may include a generally downwardly facing opening 118.

Figure 4:
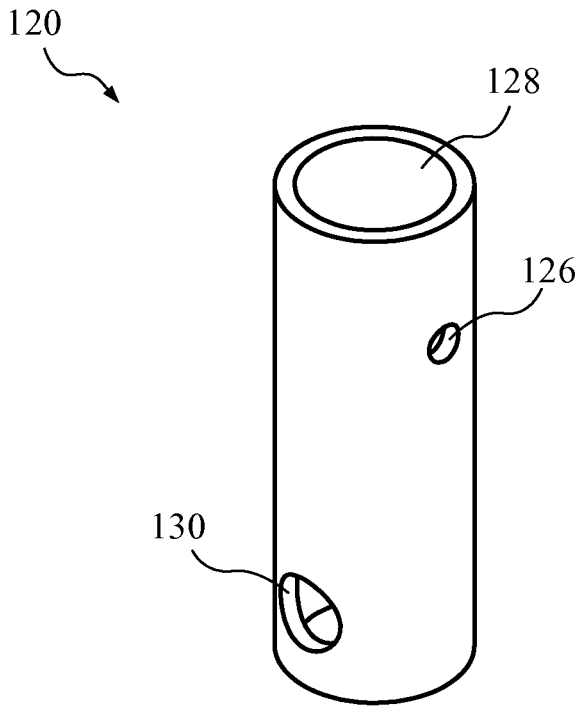
FIG. 4 is a perspective view of an example tube insert for a folding hurdle.

A tube insert 120 may be received at least partially within opening 118. Tube insert 118 may have a smaller diameter than opening 118. Tube insert 120 may be secured within opening 118 by a rivet 122, which may extend at least partially through substantially aligned holes 124, 126 through first end 104 of bar 102 and tube insert 120, respectively. Rivet 122 may prevent removal of tube insert 120 from opening 118 and/or may prevent rotation of tube insert 120 within opening 118. As shown in detail in FIG. 4, an example tube insert 120 may be generally cylindrical with hollow center 128. Tube insert 120 may include a laterally opening button hole 130.

Returning to FIG. 3, a spring 132 may be received within tube insert 120 and/or may be arranged to bias a button 134 outwardly through button hole 130. When hurdle 100 is assembled, tube insert 120 may be inserted into generally upwardly facing opening 136 of first leg 108. When first leg 108 is in its erected position, button 134 may extend at least partway through a laterally opening erected position lock hole 138 in first leg 108. When first leg 108 is its folded position, button 134 may extend at least partway through a laterally opening folded position lock hole 140 in first leg 108. In some example embodiments, erected position lock hole 138 and folded position lock hole 140 may be oriented about 90 degrees apart so that first leg 108 pivots about 90 degrees between its erected position (FIG. 1) and its folded position (FIG. 2). Button 134, erected position lock hole 138, and/or folded position lock hole 140 may comprise a first lock, and similar respective components associated with second leg 110 may comprise a second lock. In some example embodiments, a cap or plug 142 may be fitted onto first foot 112, such as into opening 144.

Figure 5:
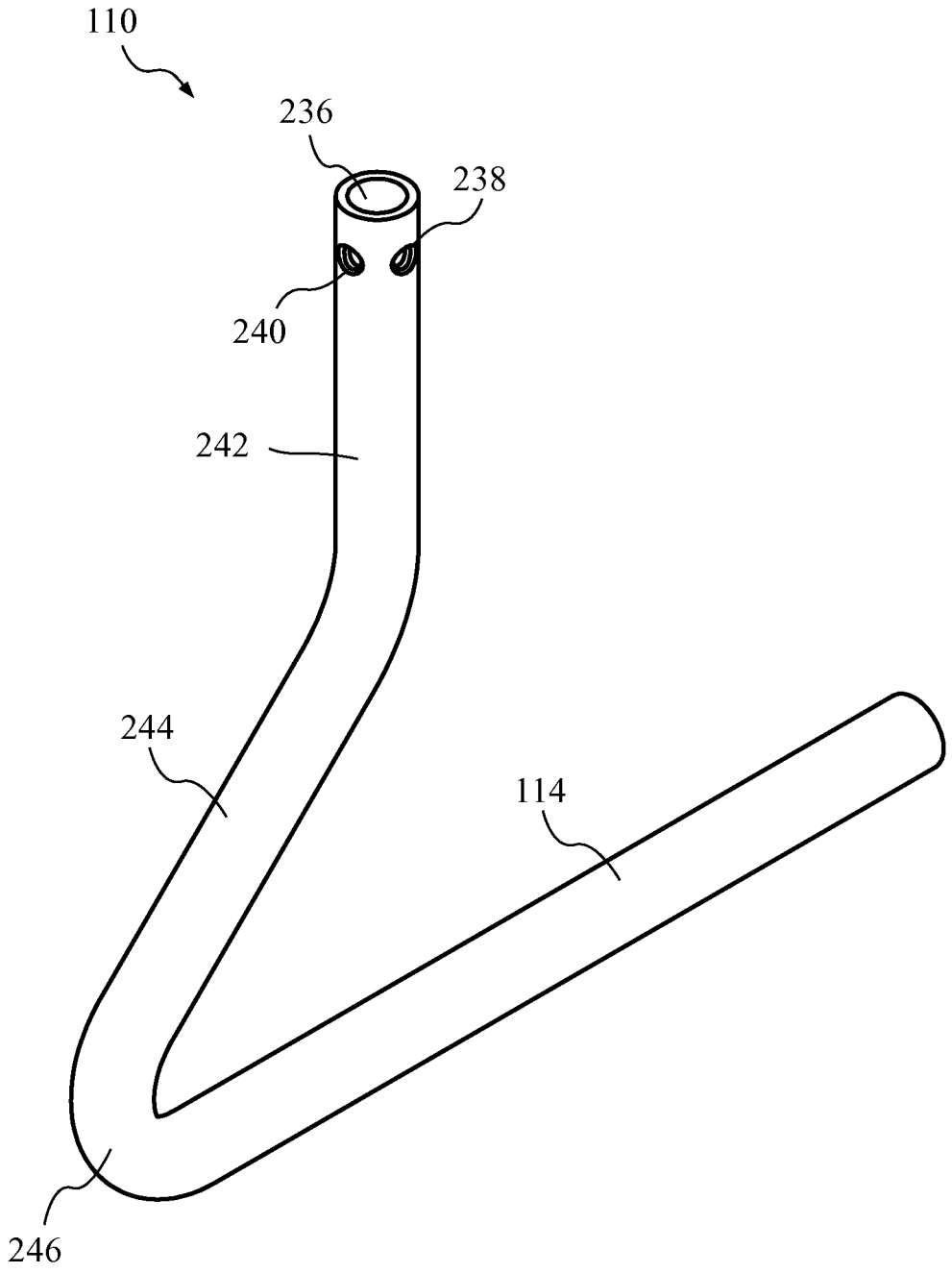
FIG. 5 is a perspective view of an example leg for a folding hurdle.

FIG. 5 is a perspective view second leg 110 for hurdle 100, in accordance with at least some embodiments of the present disclosure. Second leg 110 may be substantially similar to and/or may include features substantially similar to those of first leg 108. In some example embodiments and as illustrated in FIG. 5, second leg 110 may be substantially a mirror image of first leg 108.

Second leg 110 may include a generally upwardly facing opening 236, a laterally opening erected position lock hole 238, and/or a laterally opening folded position lock hole 240, which may be generally similar to those of first leg 108. Erected position lock hole 238 and/or folded position lock hole 240 may located on second leg 110 near opening 236. Second leg 110 may include a generally vertical portion 242, which may include opening 236, erected position lock hole 238, and/or folded position lock hole 240. Generally vertical portion 242 may transition to a generally diagonal portion 244, which may extend generally diagonally downward towards second foot 114 from vertical portion 242. A bent knee portion 246 may interpose diagonal portion 244 and second foot 114, which may be substantially horizontal. Second leg 110 may be configured to support bar 102 about 15 inches above a support surface.

Figure 6:
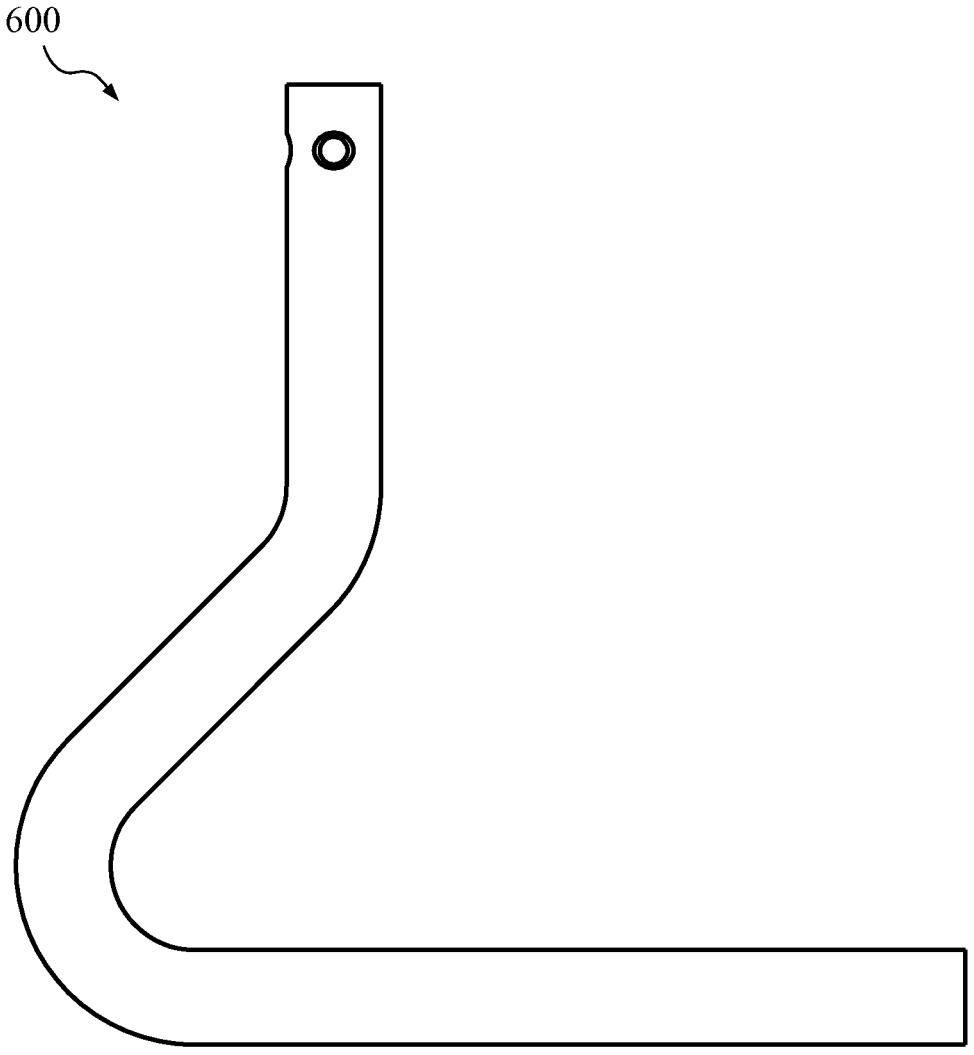
FIG. 6 is an elevation view of an alternative example leg for a folding hurdle.

FIG. 6 is a elevation view of an alternative example leg 600 for hurdle 100, in accordance with at least some embodiments of the present disclosure. Leg 600 may be generally similar to first leg 108 and/or second leg 110 described above; however, leg 600 may be configured to support bar 102 at a lower height above a support surface than first leg 108 and/or second leg 110. For example, leg 600 may be configured to support bar 102 about 12 inches above a support surface.

Figure 7:
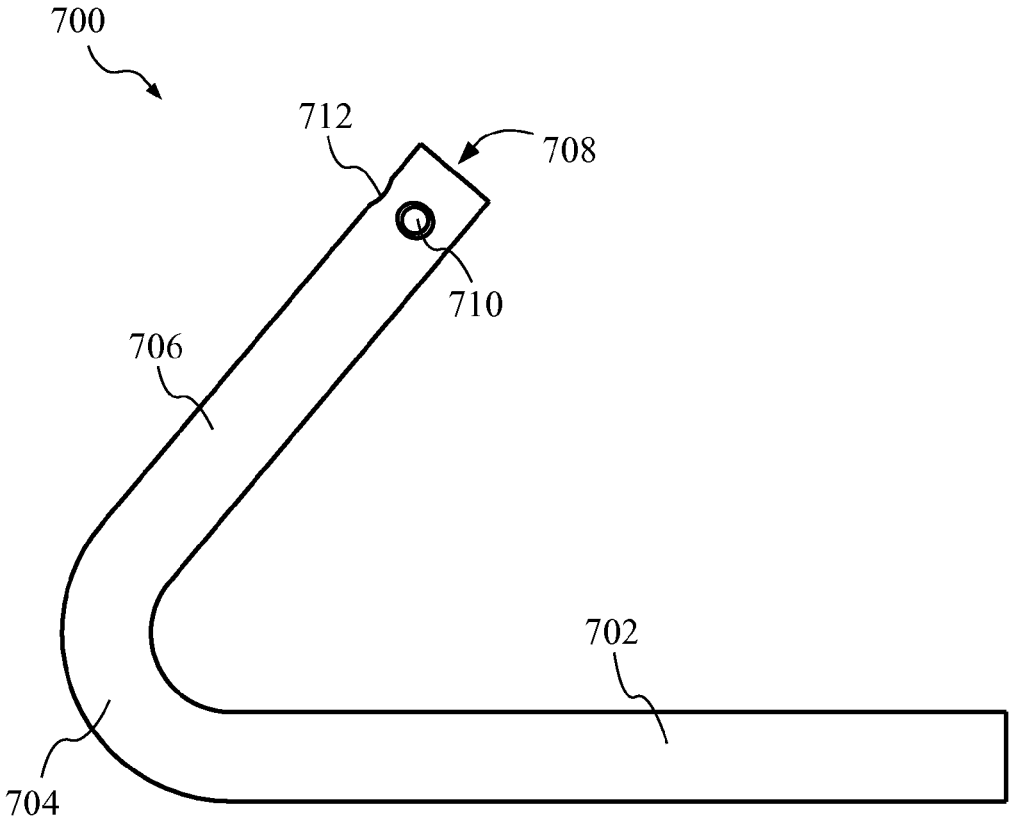
FIG. 7 is an elevation view of an alternative example leg for a folding hurdle.

FIG. 7 is a elevation view of an alternative example leg 700 for hurdle 100, in accordance with at least some embodiments of the present disclosure. Leg 700 may include a generally horizontal foot 702, which may rest on a support surface. A knee 704 may provide a transition to a diagonal portion 706, which may extend generally diagonally upward from foot 702. In some example embodiments, diagonal portion 706 may include a generally upwardly facing opening 708, an erected position lock hole 710, and/or a folded position lock hole 712 generally similar to those of first leg 108. In some example embodiments generally upwardly facing opening 708 may face generally diagonally upwardly, such as generally in line with diagonal portion 706. Leg 700 may be configured to support bar 102 about 9 inches above a support surface.

Figure 8:
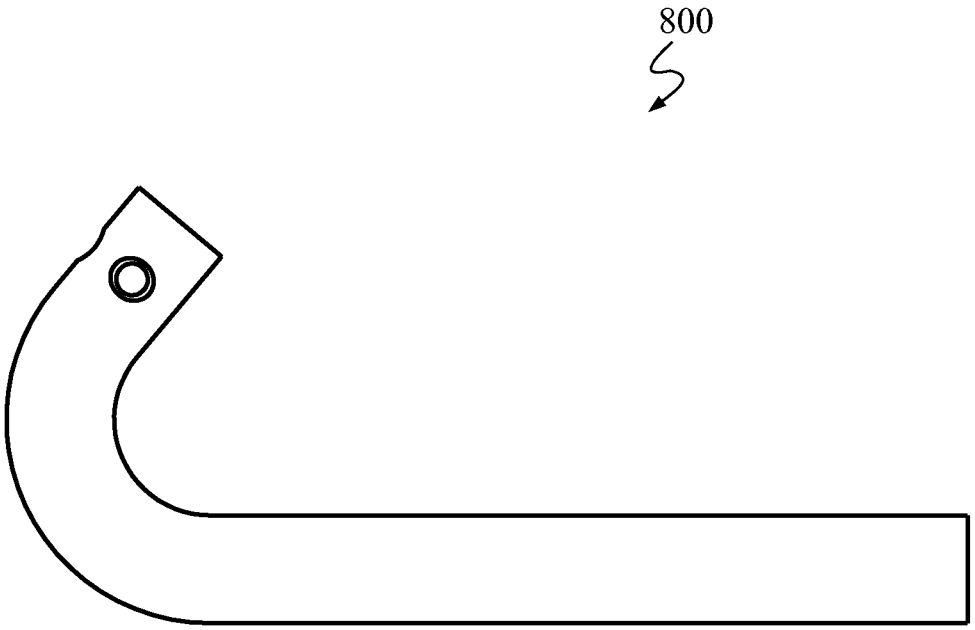
FIG. 8 is an elevation view of an alternative example leg for a folding hurdle; all arranged in accordance with at least some embodiments of the present disclosure.

FIG. 8 is a elevation view of an alternative example leg 800 for hurdle 100, in accordance with at least some embodiments of the present disclosure. Leg 800 may be generally similar to leg 700 described above; however, leg 800 may be configured to support bar 102 at a lower height above a support surface than leg 700. For example, leg 800 may be configured to support bar 102 about 6 inches above a support surface.

Referring to FIGS. 1-3, folding hurdle 100 may be operated as follows. In the erected position (FIG. 1), button 134 may be seated at least partially within erected position lock hole 138, which may prevent substantial rotation of first leg 108 relative to bar 102. When it is desired to place hurdle 100 into the folded configuration (FIG. 2), button 134 may be depressed into tube insert 120. Because button 134 may be disengaged from erected position lock hole 138, first leg 108 may be rotated relative to bar 102 while remaining substantially engaged with tube insert 120. When first leg 108 is in its folded position (e.g., generally coplanar and/or parallel with bar 102), button 134 may be substantially aligned with folded position lock hole 140. Spring 132 may push button 134 outwardly from tube insert 120 and/or into folded position lock hole 140. Engagement of button 134 with folded position lock hole 140 may prevent substantial rotation of first leg 108 relative to bar 102. Second leg 110 may be moved from its erected position to its folded position in a substantially similar manner.

When it is desired to place hurdle 100 into the erected configuration from the folded configuration, button 134 may be depressed into tube insert 120, which may substantially disengage button 134 from folded position lock hole 140. Disengaging button 134 from folded position lock hole 140 may allow rotation of first leg 108 relative to bar 102 while tube insert 120 remains substantially engaged with first leg 108. First leg 108 may be rotated into its erected position, in which button 134 may be substantially aligned with erected position lock hole 138. Spring 132 may push button 134 outwardly from tube insert 120 and/or into erected position lock hole 138. Engagement of button 134 with erected position lock hole 138 may prevent substantially rotation of first leg 108 relative to bar 102. Second leg 110 may be moved from its folded position to its erected position in a substantially similar manner.

Although embodiments described above may include tube insert 120 housing button 134 that is associated with bar 102 and lock holes (e.g., erected position lock hole 138 and/or folded position lock hole 140) that are associated with first leg 108, it is within the scope of the disclosure to utilize a tube insert and/or a button associated with a leg and one or more lock holes associated with a bar.

While example embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages of the may exist even though they may not have been explicitly discussed herein.

What is claimed is:

1. A folding hurdle comprising:

a first leg comprising a first generally horizontal foot, a first generally upwardly facing opening, and a bent knee portion interposing the first generally horizontal foot and the first generally upwardly facing opening;

a second leg comprising a second generally horizontal foot, a second generally upwardly facing opening, and a bent knee portion interposing the second generally horizontal foot and the second generally upwardly facing opening; and a generally horizontal bar comprising a first end and a second end, the first end comprising a first generally downwardly extending tube insert configured to be pivotably received within the first generally upwardly facing opening of the first leg, and the second end comprising a second generally downwardly extending tube insert configured to be pivotably received within the second generally upwardly facing opening of the second leg;

wherein the first generally downwardly extending tube insert comprises a laterally extending first spring-biased button, the first leg comprises a first erected position lock hole configured to engage the first spring-biased button when the first leg is in an erected position, and the first leg comprises a first folded position lock hole configured to engage the first spring-biased button when the first leg is in a folded position; and wherein the second generally downwardly extending tube insert comprises a laterally extending second spring-biased button, the second leg comprises a second erected position lock hole configured to engage the second spring-biased button when the second leg is in an erected position, and the second leg comprises a second folded position lock hole configured to engage the second spring-biased button when the second leg is in a folded position.

2. The folding hurdle of claim 1, wherein in its folded position, the first foot is substantially coplanar with the generally horizontal bar;

in its erected position, the first foot is generally perpendicular to the generally horizontal bar;

in its folded position, the second foot is substantially coplanar with the generally horizontal bar; and in its erected position, the second foot is generally perpendicular to the generally horizontal bar.

3. The folding hurdle of claim 1, wherein the first leg, the second leg, and the generally horizontal bar are substantially tubular.

4. The folding hurdle of claim 1, wherein the first leg, the second leg, and the generally horizontal bar comprise generally circular cross sections.

5. The folding hurdle of claim 1, wherein the first generally downwardly extending tube insert is secured in the first end of the generally horizontal bar by a first rivet; and the second generally downwardly extending tube insert is secured in the second end of the generally horizontal bar by a second rivet.

6. A method of operating a folding hurdle, the method comprising:

providing a folding hurdle comprising a generally horizontal bar, a first leg pivotably coupled to a first end of the generally horizontal bar, and a second leg pivotably coupled to a second end of the substantially horizontal bar;

disengaging a first lock preventing rotation of the first leg relative to the generally horizontal bar;

rotating the first leg from a folded position in which a first foot associated with the first leg is substantially coplanar with the generally horizontal bar to an erected position in which the first foot is generally perpendicular to the generally horizontal bar;

engaging the first lock;

disengaging a second lock preventing rotation of the second leg relative to the generally horizontal bar;

rotating the second leg from a folded position in which a second foot associated with the second leg is substantially coplanar with the generally horizontal bar to an erected position in which the second foot is generally perpendicular to the generally horizontal bar; and engaging the second lock.

7. The method of claim 6, wherein the first lock comprises a first spring-biased button extending generally outwardly from a tube insert mounted to the first end of the generally horizontal bar, the tube insert being received within the first leg, the first spring-biased button engaging a first erected position lock hole in the first leg when the first leg is in the erected position, and the first spring-biased button engaging a first folded position lock hole in the first leg when the first leg is in the folded position;

disengaging the first lock comprises depressing the first spring-biased button;

the second lock comprises a second spring-biased button extending generally outwardly from a tube insert mounted to the second end of the generally horizontal bar, the tube insert being received within the second leg, the second spring-biased button engaging a second erected position lock hole in the second leg when the second leg is in the erected position, and the second spring-biased button engaging a second folded position lock hole in the second leg when the second leg is in the folded position; and disengaging the second lock comprises depressing the second spring-biased button.

8. The method of claim 6, wherein in its folded position, the first foot is generally parallel with the generally horizontal bar; and in its folded position, the second foot is generally parallel with the generally horizontal bar.

9. The method of claim 6, wherein the first erected position lock hole and the first folded position lock hole are about 90 degrees apart; and the second erected position lock hole and the second folded position lock hole are about 90 degrees apart.

* * * * *